US008179283B2

(12) United States Patent
O'Flynn

(10) Patent No.: US 8,179,283 B2
(45) Date of Patent: May 15, 2012

(54) MULTI-STAGE LABEL

(75) Inventor: Mark James O'Flynn, Balwyn North (AU)

(73) Assignee: Thales Australia Limited, New South Wales (AU)

( * ) Notice: Subject to any disclaimer, the term of this patent is extended or adjusted under 35 U.S.C. 154(b) by 584 days.

(21) Appl. No.: 12/381,012

(22) Filed: Mar. 5, 2009

(65) Prior Publication Data

US 2010/0141481 A1 Jun. 10, 2010

(30) Foreign Application Priority Data

Dec. 9, 2008 (AU) ..... 2008906351

(51) Int. Cl.
*G08B 21/00* (2006.01)

(52) U.S. Cl. ..... 340/945

(58) Field of Classification Search ..... 340/945, 340/973–980, 990; 701/3; 345/418, 440
See application file for complete search history.

(56) References Cited

U.S. PATENT DOCUMENTS 3,652,836 A 3/1972 Richardson et al.
4,071,843 A 1/1978 Marien
4,692,869 A 9/1987 King et al.
5,111,400 A 5/1992 Yoder
5,179,377 A 1/1993 Hancock
6,842,122 B1 * 1/2005 Langner et al. ..... 340/945
6,985,801 B1 * 1/2006 Straub et al. ..... 701/3
7,131,060 B1 * 10/2006 Azuma ..... 715/260
2010/0117887 A1 5/2010 O'Flynn
2010/0127847 A1 * 5/2010 Evans et al. ..... 340/461
2010/0141481 A1 6/2010 O'Flynn
2010/0153875 A1 6/2010 O'Flynn

* cited by examiner

*Primary Examiner* — Phung Nguyen
(74) *Attorney, Agent, or Firm* — Wood, Phillips, Katz, Clark & Mortimer

(57) ABSTRACT

An aspect of the present invention provides a method for providing information to an air traffic controller. The method comprises the steps of: displaying, on a video display, a symbol representative of a position of an aircraft and a first stage of a multi-stage label comprising information relating to the aircraft (210); and displaying, on the video display, a second stage of the multi-stage label comprising additional information relating to the aircraft when a user-controlled cursor is brought into a vicinity of the multi-stage label (220). The first stage of the multi-stage label occupies a smaller footprint on the video display than the second stage. Additional stages of the multi stage label may also be displayed in response to user action (e.g. rotation of a scroll wheel of a computer mouse or other pointing device). Each stage of the multi-stage label may be locked in place, or pinned, through selection of part of the label, via a mouse click or similar action.

25 Claims, 3 Drawing Sheets

MULTI-STAGE LABEL

TECHNICAL FIELD

The present invention relates generally to air traffic control systems and more particularly to the display of information to air traffic controllers of an air traffic control system.

BACKGROUND

Air Traffic Control (ATC) aims to provide a safe, orderly and expeditious flow of air traffic. This is achieved by ensuring separation of aircraft from other aircraft and terrain whilst the aircraft travel from respective departure points to destination points, with as little restriction or external impact as possible. An efficient air traffic control system is one in which aircraft flow is restricted only by volume and not by limitations of the system.

There are two principle methods that have been employed to provide protection from the hazard of collisions between aircraft. The first method is based on the concept that when aircraft are being flown in weather conditions where pilots can see and be seen, the individual pilot is responsible directly for avoiding collisions with other aircraft. This follows the same connotation that each automobile driver looks out for other traffic. The other principle method relies on the ground-based ATC service, which is designed to provide separation between aircraft operating in accordance with instrument flight rules, primarily when weather conditions do not allow the pilot to see and be seen. The system provides instructions and information to the pilot of an aircraft about altitudes and flight paths to be followed.

At the heart of the ATC system is an air traffic controller who accesses and assesses information from a variety of sources. The information provided enables the air traffic controller to make decisions, develop plans, communicate intentions and issue instructions that ensure the aircraft operate as intended in a safe, orderly and expeditious manner. The workload of the air traffic controller can be heavy at times. To maintain a controller's workload at a safe and acceptable flight level, the airspace is divided into areas called sectors. Each sector is a defined geographical area that is made up of a number of airways or routes, airports, and navigation aids. Each sector is assigned a certain number of air traffic controllers and assistants, who are responsible for all aircraft in their designated sector. During periods of low traffic density, provisions are made to combine sectors.

Supporting the air traffic controller in this task is an increasing array of automation, communications and surveillance equipment, such as computer processing, radio, and radar. The air traffic controller receives, assesses, and responds to a continuous flow of visual and auditory cues related to the aircraft under their control, from the various support systems available to the air traffic controller. The responses to the various cues results in a steady stream of instructions to aircraft and coordination with other sectors that enables the safe progress of air traffic.

Air traffic control is a highly conceptual and real-time information-based process that places a complex set of cognitive demands on a human operator. Air traffic controllers rely heavily on visual and auditory cues to maintain situational awareness of air traffic and assist in prioritizing the many actions that need to be performed.

In modern air traffic control environments, Air traffic controllers generally focus on graphical representation of aircraft that are displayed on computer workstations. Typically, the position of each aircraft is represented as a symbol with an associated label displaying information relating to the aircraft. The amount of information displayed in a label is generally limited on account of the need to reduce screen clutter.

Existing systems include various tools and on-screen display windows that disadvantageously occupy a substantial footprint on the screen or visual display unit. Air traffic controllers typically have to open and/or display multiple windows to access additional information relating to a particular aircraft or flight. A further disadvantage of existing systems is the lack of a direct relationship or link between the display windows and the relevant aircraft symbol (track). The only direct link between the information in a display window and the related aircraft symbol is thus in the mind of the air traffic controller. This situation is unsatisfactory as it introduces a significant possibility for the introduction of human error into the air traffic control process.

Accordingly, a need exists to provide information relating to an aircraft or flight that occupies a minimal footprint on the screen or video display. Another need exists to provide rapid and intuitive access to further information relating to the same aircraft or flight. A further need exists to unambiguously link the information and further information with the particular aircraft the information relates to. Fulfilment of one or more of these needs will enable Air traffic controllers to remain focused on an aircraft symbol and associated information, thereby maintaining situational awareness and enhancing safe air traffic management and control.

SUMMARY

An aspect of the present invention provides a method for providing information to an air traffic controller. The method comprises the steps of: displaying, on a video display, a symbol representative of a position of an aircraft and a first stage of a multi-stage label comprising information relating to the aircraft; and displaying, on the video display, a second stage of the multi-stage label comprising additional information relating to the aircraft when a user-controlled cursor is brought into the vicinity of the multi-stage label. The first stage of the multi-stage label occupies a smaller footprint on the video display than the second stage.

Another aspect of the present invention provides a computer system for providing information to an air traffic controller. The computer system comprises: a video display for displaying information; at least one input device for inputting information; and a computer module comprising memory for storing data and instructions and at least one processor coupled to the memory, the video display and the at least one input device. The computer system is programmed to: display, on the video display, a symbol representative of a position of an aircraft and a first stage of a multi-stage label comprising information relating to the aircraft; and display, on the video display, a second stage of the multi-stage label comprising additional information relating to the aircraft when a user-controlled cursor is brought into the vicinity of the multi-stage label using the at least one input device. The first stage of the multi-stage label occupies a smaller footprint on the video display than the second stage.

Another aspect of the present invention provides a computer program product comprising a computer software program for providing information to an air traffic controller. The computer program product comprises: computer program code for displaying, on a video display, a symbol representative of a position of an aircraft and a first stage of a multi-stage label comprising information relating to the aircraft; and computer program code for displaying, on the video display, a second stage of the multi-stage label comprising additional information relating to the aircraft when a user-controlled cursor is brought into the vicinity of the multi-stage label. The first stage of the multi-stage label occupies a smaller footprint on the video display than the second stage.

The first stage of the multi-stage label may comprise one or more items from the list of items consisting of: identification of the aircraft; and flight level of the aircraft.

The additional information relating to the aircraft may comprise one or more items from the list of items consisting of: destination; aircraft type; and runway assigned.

The method may comprise the further step of displaying, on the video display, a further stage of the multi-stage label in response to user operation of an input device. Such user operation may, for example, comprise rotation in a first direction of a scroll wheel of a computer pointing device.

The method may comprise the further step of terminating display of the further stage of the multi-stage label (e.g. returning to display of the second stage) in response to rotation of the scroll wheel in a reverse direction to the first direction.

The method may comprise the further step of maintaining a currently displayed stage of the multi-stage label in response to selection of the currently displayed stage.

The aircraft symbol and the related multi-stage label may be visually coupled to each other on the visual display.

The first stage of the multi-stage label may be adapted to display a minimal amount of critical data to minimise the footprint of the first stage on the video display.

BRIEF DESCRIPTION OF THE DRAWINGS

A small number of embodiments are described hereinafter, by way of example only, with reference to the accompanying drawings in which.

DETAILED DESCRIPTION

Embodiments of methods, systems and computer program products for providing information to air traffic controllers are described hereinafter.

Figure 1:
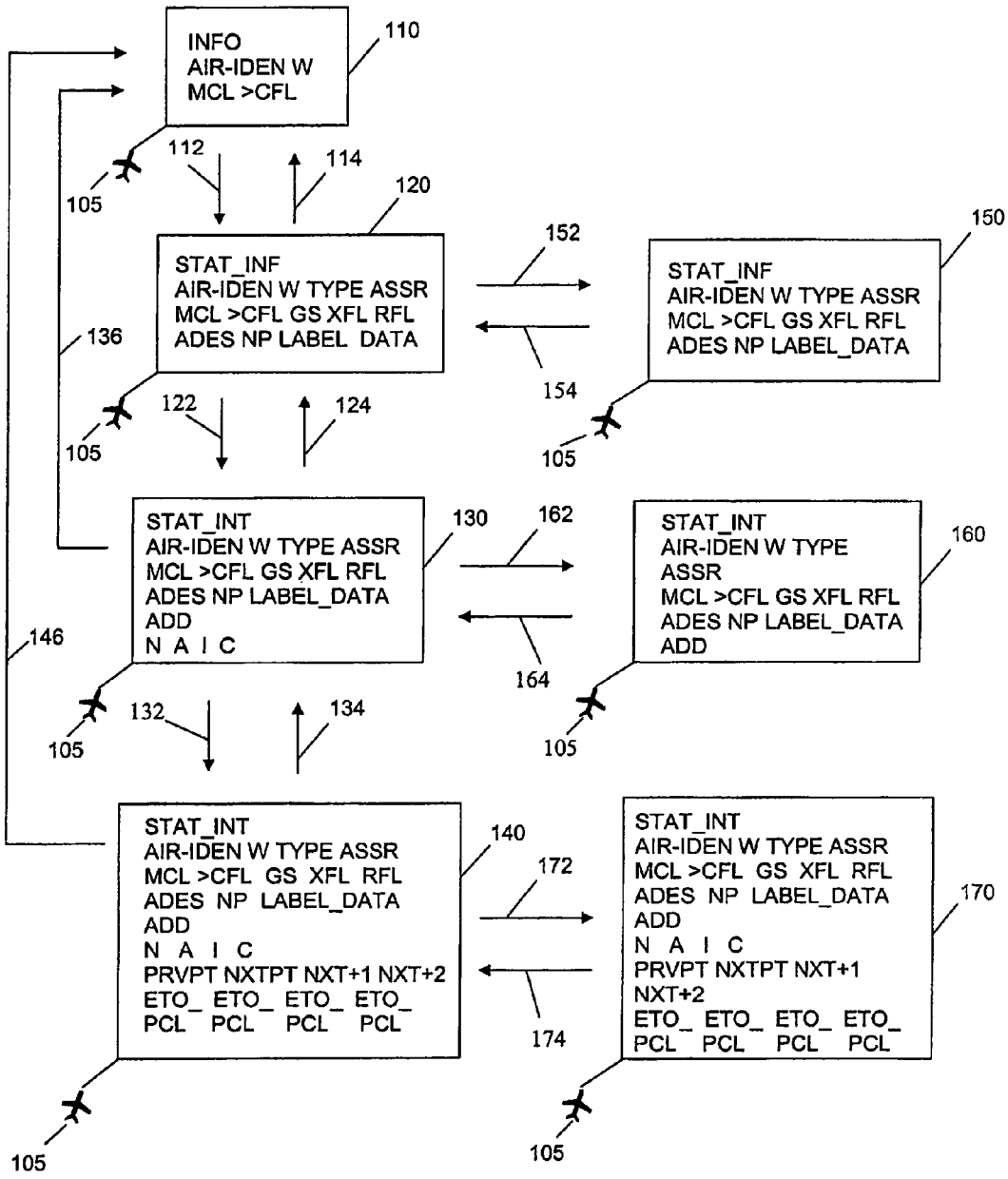
FIG. 1 is a schematic diagram of a multi-stage label in accordance with an embodiment of the present invention.

FIG. 1 shows a multi-stage label in accordance with an embodiment of the present invention. Control and interaction with the multi stage label is performed via a computer pointing device, normally a mouse. For the purpose of example, the following description will assume the use of a computer mouse with integrated scroll wheel device, although other devices with similar input capabilities, such as a digitiser or track ball, may be used.

Referring to FIG. 1, the multi-stage label provides information relating to an aircraft represented by the symbol or icon 105. It is of little relevance to explain the meaning of the fields that are displayed on the labels shown in FIG. 1, suffice to say that the fields relate to current information associated with the aircraft. What is relevant is to explain the mechanism to operate the multi stage label and the behaviour of the multi stage label. As shown in FIG. 1, the multi-stage label may be expanded through various stages 110, 120, 130 and 140 to display pertinent and/or contextual information relating to the aircraft 105.

At its simplest (i.e., the first stage 110), the multi-stage label displays a minimal amount of critical information relating to the aircraft 105. This minimises the footprint of the multi-stage label on the screen or video display, thus minimising screen clutter. As shown in the first stage 110 of the multi-stage label, such information may comprise identification of an aircraft/flight and flight level (e.g. standard nominal altitude of an aircraft) information.

When a user-controlled cursor is brought into the vicinity of the first stage 110 of the multi-stage label, the multi-stage label expands to a second stage 120, which displays additional information such as destination, aircraft type and runway assigned. For example, the second stage 120 may be displayed in response to the user-controlled cursor being moved over the label 112 by an air traffic controller or user. If the cursor is moved away from the multi-stage label 114, the multi-stage label reverts to the first stage 110.

Further additional information may be displayed in subsequent stages in response to the user interacting with the multi-stage label. For example, a further stage 130 may display additional fields such as operational notes and planned route of the aircraft. The third stage 130 is displayed in response to the air traffic controller or user rotating the scroll wheel on the mouse pointing device in one particular direction. If the scroll wheel is rotated in the opposite direction 124, the multi-stage label reverts to the second stage 120.

Whilst in the third stage 130, the multi stage label may be expanded further to display even more information by further rotation of the mouse pointing device scroll wheel. This fourth stage 140 contains more detailed information relating to the aircraft, which could include detailed route information such as estimates for reporting points in the route. Rotation of the scroll wheel in the opposite direction will result in the multi stage label reverting to the third stage 130.

With subsequent user interactions, additional fields can be configured for display in subsequent stages of the multi-stage label, thus creating the effect of a cascading revelation of information pertinent to the user's needs. In order to minimise the footprint occupied by the multi-stage label, data or information fields are preferably grouped together and associated with a tab displayed on the last line of the multi-stage label. When the tab is selected, the associated fields are displayed. This significantly minimises the footprint of the multi-stage label on the screen or video display.

At any stage, the multi-stage label may be 'set' or 'pinned' to maintain the revealed stages as a fixed display. For example, a pinned second stage 150 may be obtained by an air traffic controller or user performing a mouse click 152 when the cursor is in the vicinity of the second stage 120. Similarly, a pinned third stage 160 may be obtained by the air traffic controller or user performing a mouse click 162 when the cursor is in the vicinity of the third stage 130 and a pinned fourth stage 170 may be obtained by the air traffic controller or user performing a mouse click 172 when the cursor is in the vicinity of the fourth stage 140. The multi-stage label may be reverted to the second, third and fourth stages 120, 130 and 140 by the air traffic controller or user performing a mouse click 154, 164 and 174, respectively.

At any stage, the multi-stage label may be reverted to display the first stage 110 by simply moving the cursor (mouse) away from the particular stage currently being displayed. For example, movements 136 and 146 of the mouse away from the third and fourth stages 130 and 140, respectively, cause the multi-stage label to revert to the first stage 110.

The multi-stage label is preferably continuously displayed while the location of a related aircraft is displayed.

Figure 2:
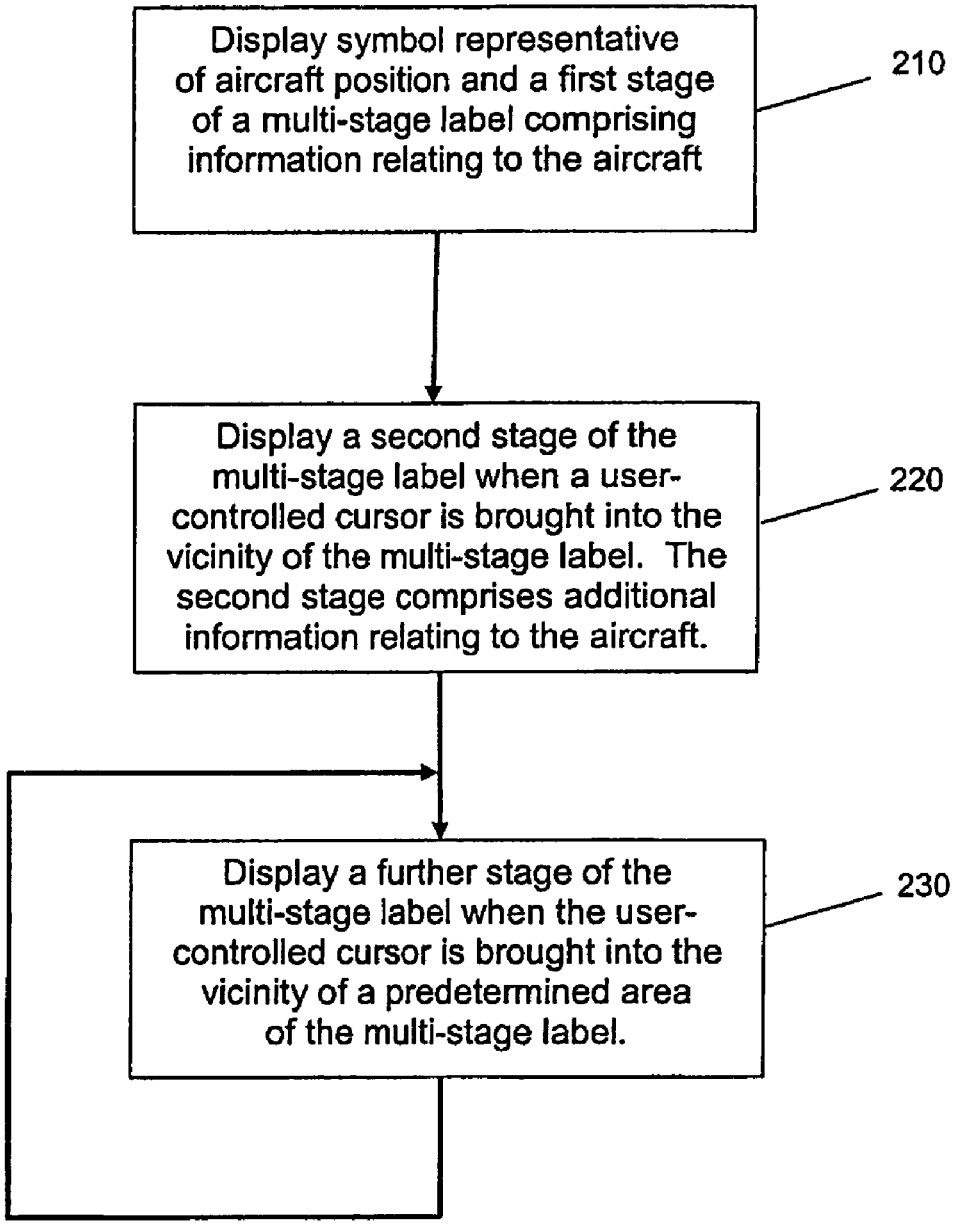
FIG. 2 is flow chart of a method for providing information to an air traffic controller in accordance with an embodiment of the present invention.

FIG. 2 shows a flow chart of a method for providing information to an air traffic controller. Referring to FIG. 2, a symbol representative of a position of an aircraft and a first stage of a multi-stage label comprising information relating to the aircraft are displayed on a video display at step 210.

At step 220, a second stage of the multi-stage label is displayed on the video display when a cursor is brought into a vicinity of the multi-stage label. The second stage typically comprises additional information relating to the aircraft. The first stage of the multi-stage label occupies a smaller footprint on the visual display unit than the second stage.

The first stage of the multi-stage label may, for example, be adapted to display identification information for the aircraft and/or the current flight level (e.g. standard nominal altitude of an aircraft) of the aircraft. The second stage of the multi-stage label may, for example, be adapted to display destination; aircraft type; and/or runway assigned.

At optional step 230, a further stage of the multi-stage label may be displayed when the user-controlled cursor is brought into a vicinity of a predetermined area of the multi-stage label. The predetermined area may comprise a tab displayed on the multi-stage label and the cursor may be brought into a vicinity of the tab by operation of a scroll wheel of a mouse. This step may be repeated to further expand the content of the multi stage label.

At any of the multiple stages of the multi-stage label, the currently displayed stage may optionally be maintained (i.e., pinned) by an air traffic controller selecting the currently displayed stage (e.g., by way of a mouse click).

Figure 3:
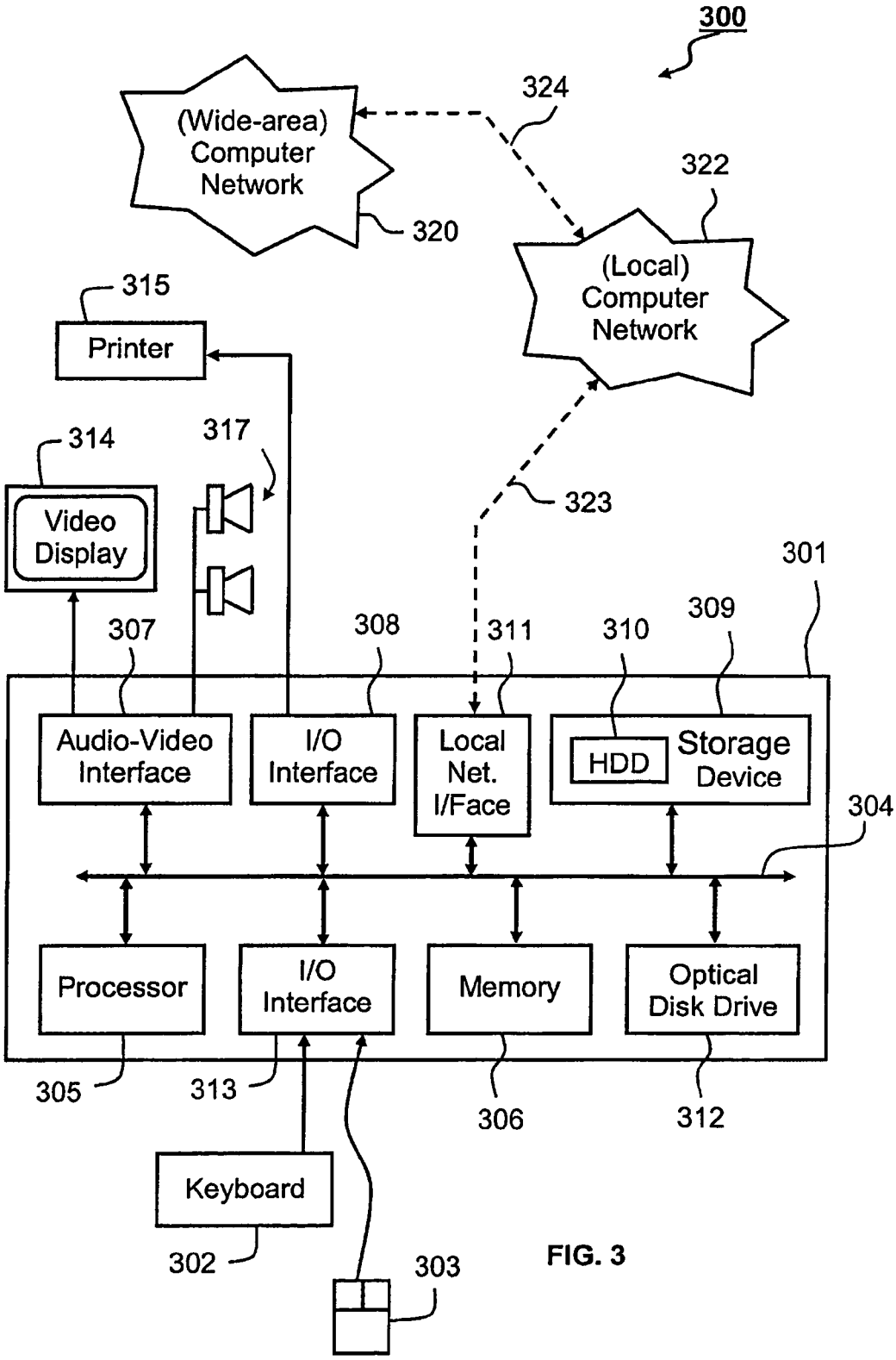
FIG. 3 is a schematic block diagram of a computer system with which embodiments of the present invention may be practised.

FIG. 3 shows a schematic block diagram of a computer system 300 that can be used to practice the methods described hereinbefore. More specifically, the methods described hereinbefore with reference to FIGS. 1 and 2 may be implemented using a computer system 300, such as that shown in FIG. 3, in which the methods may be implemented as software, such as one or more application programs executable within the computer system 300. The computer system 300 may be provided with radar data, flight plans, and information from other sources as is well known in the air traffic control industry. In particular, the steps of the method of FIG. 2 are effected by instructions in the software that are carried out within the computer system 300. The instructions may be formed as one or more computer program code modules, each for performing one or more particular tasks. The software may be stored in a computer readable medium, including the storage devices described hereinafter, for example. The software is loaded into the computer system 300 from the computer readable medium and then executed by the computer system 300. A computer readable medium having such software or computer program recorded on the computer readable medium is a computer program product. The use of the computer program product in the computer system 300 preferably effects an advantageous apparatus for providing information to an air traffic controller.

As shown in FIG. 3, the computer system 300 is formed by a computer module 301, input devices such as a keyboard 302 and a mouse pointer device and/or other human machine interface device 303, and output devices including a printer 315, a video display 314 and loudspeakers 317. The video display 314 maybe a cathode ray tube type device, an LCD monitor or other suitable device for graphically displaying air traffic control information. A Local Network Interface device 311 may be used by the computer module 301 for communicating to and from a local computer network 322 via a connection 323, and to and from a wide-area network (WAN) 320, such as a private WAN, via connection 324.

The computer module 301 typically includes at least one processor 305, and a memory 306, for example formed from semiconductor random access memory (RAM), read only memory (ROM) and/or flash memory. The module 301 also includes a number of input/output (I/O) interfaces including an audio-video interface 307 that couples to the visual display 314 and loudspeakers 317, an I/O interface 313 for the keyboard 302 and mouse 303 (or other pointing device) and an interface 308 for the printer 315. The computer module 301 also has a local network interface 311 which, via a connection 323, permits coupling of the computer system 300 to a local computer network 322, known as a Local Area Network (LAN). As also illustrated, the local network 322 may also couple to the wide area network 320 via a connection 324, which would typically include a so-called "firewall" device or similar functionality. The interface 311 may be formed by an Ethernet™ circuit card.

Storage devices 309 are provided and typically include a hard disk drive (HDD) 310. Other devices such as a floppy disk drive, read/write optical drive and a magnetic tape drive (not illustrated) may also be used. An optical disk drive 312 is typically provided to act as a non-volatile source of data. Portable memory devices, such optical disks (e.g., CD-ROM, DVD), USB-RAM, and floppy disks for example may then be used as appropriate sources of data to the system 300.

The components 305 to 313 of the computer module 301 typically communicate via an interconnected bus 304 and in a manner which results in a conventional mode of operation of the computer system 300 known to those skilled in the art. Examples of computers on which the described arrangements can be practised include Personal Computers, workstations, servers or similar computer systems evolved there from.

Typically, the application programs discussed hereinbefore are resident on the hard disk drive 310, which are read and controlled in execution by the processor 305. Intermediate storage of such programs and any data fetched from the networks 320 and 322 may be accomplished using the semiconductor memory 306, possibly in concert with the hard disk drive 310. In some instances, the application programs may be supplied to the user encoded on one or more CD-ROM and read via the corresponding drive 312, or alternatively may be read by the user from the networks 320 or 322. Still further, the software can also be loaded into the computer system 300 from other computer readable media Computer readable media refers to any storage medium that participates in providing instructions and/or data to the computer system 300 for execution and/or processing. Examples of such media include floppy disks, magnetic tape, CD-ROM, a hard disk drive, whether or not such devices are internal or external of the computer module 301.

The application programs and/or code modules mentioned above may be executed to implement one or more graphical user interfaces (GUIs) to be rendered or otherwise represented upon the display 314. Through manipulation of the keyboard 302 and the mouse 303, a user of the computer system 300 and the application may manipulate the interface to provide controlling commands and/or input to the applications associated with the GUI(s).

The methods described hereinbefore with reference to FIGS. 1 and 2 may alternatively be implemented in dedicated hardware such as one or more integrated circuits performing the functions or sub functions of graphically displaying air traffic control information in an air traffic control system. Such dedicated hardware may include graphic processors, digital signal processors, or one or more microprocessors and associated memories.

Embodiments described hereinbefore advantageously reduce screen clutter by displaying the most critical information relating to an aircraft or flight and enabling immediate access to additional related information. The additional information may be grouped in descending order of importance and made available for display or modification through an intuitive and rapidly operable combination of actions using a pointing device (e.g. mouse rollover, scroll and click).

Furthermore, compaction algorithms may be used to determine critical information, thus enabling the display of information based on exception rather than on the basis of a default display of standard information.

Embodiments described hereinbefore also enable direct linking of the display and/or modification of aircraft and/or flight information to air traffic controller or user interaction with the multi-stage label.

The foregoing advantages reduce an air traffic controller's time spent searching for and/or obtaining necessary information, thus increasing the time available for performing the primary air traffic management functions and thereby increasing systemic safety.

The foregoing description provides exemplary embodiments only, and is not intended to limit the scope, applicability or configurations of the present invention. Rather, the description of the exemplary embodiments provides those skilled in the art with enabling descriptions for implementing an embodiment of the invention. Various changes may be made in the function and arrangement of elements without departing from the spirit and scope of the invention as set forth in the claims hereinafter.

Where specific features, elements and steps referred to herein have known equivalents in the art to which the invention relates, such known equivalents are deemed to be incorporated herein as if individually set forth. Furthermore, features, elements and steps referred to in respect of particular embodiments may optionally form part of any of the other embodiments unless stated to the contrary.

Certain embodiments and/or examples are described using a mouse with a scroll wheel as a pointing device. However, those skilled in the art will appreciate that other types of pointing devices may alternatively be used by an air traffic controller to control the position of a cursor on a video display.

The term "comprising" as used in the context of the present specification is intended to have the open-ended non-exclusive meaning of "including principally, but not necessarily solely" and not the meaning of "consisting essentially of" or "consisting solely of". Grammatical variations of the term "comprising", such as "comprise, "comprises" and "is comprised of", are intended to have corresponding meanings.

The claims defining the invention are as follows:

1. A method for providing information to an air traffic controller, said method comprising the steps of:

displaying, on a video display, a symbol representative of a position of an aircraft and a first stage of a multi-stage label comprising information relating to said aircraft; and displaying, on said video display, a second stage of said multi-stage label comprising additional information relating to said aircraft when a user-controlled cursor is brought into a vicinity of said multi-stage label;

wherein said first stage of said multi-stage label occupies a smaller footprint on said video display than said second stage.

2. The method of claim 1, wherein said first stage of said multi-stage label comprises one or more items from the list of items consisting of: identification of said aircraft; and flight level of said aircraft.

3. The method of claim 1, wherein said additional information relating to said aircraft comprises one or more items from the list of items consisting of: destination; aircraft type; and runway assigned.

4. The method of claim 1, comprising the further step of displaying, on said video display, a further stage of said multi-stage label in response to user operation of an input device.

5. The method of claim 4, wherein said user operation of said input device comprises rotation in a first direction of a scroll wheel of a computer pointing device.

6. The method of claim 5, comprising the further step of terminating display of said further stage of said multi-stage label in response to rotation of said scroll wheel in a reverse direction to said first direction.

7. The method of claim 1, comprising the further step of maintaining a currently displayed stage of said multi-stage label by selecting said currently displayed stage.

8. The method of claim 1, wherein said aircraft symbol and said related multi-stage label are visually coupled to each other on said visual display.

9. The method of claim 1, wherein said first stage of said multi-stage label is adapted to display a minimal amount of critical data to minimise the footprint of said first stage on said video display.

10. A computer system for providing information to an air traffic controller, said computer system comprising:

a video display for displaying information;

at least one input device for inputting information; and a computer module comprising memory for storing data and instructions and at least one processor coupled to said memory, said video display and said at least one input device;

wherein said computer system is programmed to:

display, on said video display, a symbol representative of a position of an aircraft and a first stage of a multi-stage label comprising information relating to said aircraft; and display, on said video display, a second stage of said multi-stage label comprising additional information relating to said aircraft when a user-controlled cursor is brought into a vicinity of said multi-stage label using said at least one input device;

wherein said first stage of said multi-stage label occupies a smaller footprint on said video display than said second stage.

11. The computer system of claim 10, wherein said first stage of said multi-stage label comprises one or more items from the list of items consisting of: identification of said aircraft; and flight level of said aircraft.

12. The computer system of claim 10, wherein said additional information relating to said aircraft comprises one or more items from the list of items consisting of: destination; aircraft type; and runway assigned.

13. The computer system of claim 10, further programmed to display on said video display, a further stage of said multi-stage label in response to rotation of a scroll wheel of said input device in a first direction.

14. The computer system of claim 13, further programmed to terminate display of said further stage of said multi-stage label in response to rotation of said scroll wheel of said input device in a reverse direction to said first direction.

15. The computer system of claim 10, further programmed to maintain a currently displayed stage of said multi-stage label in response to selection of said currently displayed stage using said at least one input device.

16. The computer system of claim 10, wherein said aircraft symbol and said related multi-stage label are visually coupled to each other on said visual display.

17. The computer system of claim 10, wherein said first stage of said multi-stage label is adapted to display a minimal amount of critical data to minimise the footprint of said first stage on said video display.

18. A computer program product comprising a computer readable storage medium having a computer software program recorded thereon for providing information to an air traffic controller, said computer program product comprising:

computer program code for displaying, on a video display, a symbol representative of a position of an aircraft and a first stage of a multi-stage label comprising information relating to said aircraft; and computer program code for displaying, on said video display, a second stage of said multi-stage label comprising additional information relating to said aircraft when a user-controlled cursor is brought into a vicinity of said multi-stage label;

wherein said first stage of said multi-stage label occupies a smaller footprint on said video display than said second stage.

19. The computer program product of claim 18, wherein said first stage of said multi-stage label comprises one or more items from the list of items consisting of: identification of said aircraft; and flight level of said aircraft.

20. The computer program product of claim 18, wherein said additional information relating to said aircraft comprises one or more items from the list of items consisting of: destination; aircraft type; and runway assigned.

21. The computer program product of claim 20, further comprising computer program code for terminating display of said further stage of said multi-stage label in response to rotation of said scroll wheel of said input device in a reverse direction to said first direction.

22. The computer program product of claim 18, further comprising computer program code for displaying, on said video display, a further stage of said multi-stage label in response to rotation of a scroll wheel of said input device in a first direction.

23. The computer program product of claim 18, further comprising computer program code for maintaining a currently displayed stage of said multi-stage label by selecting said currently displayed stage.

24. The computer program product of claim 18, wherein said aircraft symbol and said related multi-stage label are visually coupled to each other on said visual display.

25. The computer program product of claim 18, wherein said first stage of said multi-stage label is adapted to display a minimal amount of critical data to minimise the footprint of said first stage on said video display.

* * * * *